US007004560B2

(12) United States Patent
Yamada et al.

(10) Patent No.: US 7,004,560 B2
(45) Date of Patent: Feb. 28, 2006

(54) CLEANING DEVICE FOR CLEANING INKJET HEAD

(75) Inventors: Takahiro Yamada, Hitachinaka (JP); Hitoshi Kida, Hitachinaka (JP); Hidetoshi Fujii, Hitachinaka (JP)

(73) Assignee: Ricoh Printing Systems Ltd., Tokyo (JP)

( * ) Notice: Subject to any disclaimer, the term of this patent is extended or adjusted under 35 U.S.C. 154(b) by 104 days.

(21) Appl. No.: 10/658,712

(22) Filed: Sep. 10, 2003

(65) Prior Publication Data

US 2004/0046828 A1 Mar. 11, 2004

(30) Foreign Application Priority Data

Sep. 10, 2002 (JP) ..... P2002-264273

(51) Int. Cl.
*B41J 2/165* (2006.01)

(52) U.S. Cl. ..... 347/30; 347/29

(58) Field of Classification Search ..... 347/22, 347/27, 29, 25, 30, 32, 40, 77, 82
See application file for complete search history.

(56) References Cited

U.S. PATENT DOCUMENTS

| | | | | |
|---|---|---|---|---|
| 4,734,705 | A * | 3/1988 | Rezanka et al. | 347/75 |
| 5,574,485 | A * | 11/1996 | Anderson et al. | 347/27 |
| 6,623,113 | B1 * | 9/2003 | Yamada et al. | 347/77 |
| 6,749,291 | B1 * | 6/2004 | Satou et al. | 347/77 |
| 6,767,087 | B1 * | 7/2004 | Yamada et al. | 347/77 |
| 6,796,632 | B1 * | 9/2004 | Yamada et al. | 347/22 |

FOREIGN PATENT DOCUMENTS

| | | |
|---|---|---|
| JP | 2001-47622 | 2/2001 |
| JP | 2001-260392 | 9/2001 |

* cited by examiner

*Primary Examiner*—Shih-Wen Hsieh
(74) *Attorney, Agent, or Firm*—Whitman, Curtis & Christofferson P.C.

(57) ABSTRACT

A charge/deflecting electrode is provided on an orifice surface of an inkjet head near nozzle orifices formed in the orifice surface. A suction tube is pressed against the orifice surface and the electrode to retain a space therebetween. When a negative pressure is generated in a suction hole of the suction tube, ink and foreign matter are sucked from the nozzle orifices. The space is asymmetric on left and right sides so the negative pressure develops a whirlpool-shaped flow including a mixture of air and ink near the suction hole.

24 Claims, 5 Drawing Sheets

CLEANING DEVICE FOR CLEANING INKJET HEAD

BACKGROUND OF THE INVENTION

1. Field of the Invention

The present invention relates to an inkjet recording device that reliably and rapidly prints high-quality images and includes a recording head and a cleaning device for cleaning the recording head.

2. Related Art

A line-scan inkjet recording device has been known for printing images on a continuous recording sheet at high speeds. The line-scan inkjet recording device includes an inkjet recording head that extends across the entire width of the continuous recording sheet. The inkjet recording head is formed with a row of orifices through which ink droplets are ejected. The recording head is aligned in confrontation with a surface of the recording sheet. The recording sheet is transported in a main scan direction rapidly while the recording head is ejecting ink droplets from selective ones of the orifices in accordance with a recording signal. By transporting the recording sheet in the main scan direction while ejecting ink in this manner, recording dots can be selectively formed in scan lines on the recording sheet to produce a desired recording image.

There have been proposed various types of line-scan inkjet recording devices, such as devices that use a continuous inkjet type recording head and devices that use a drop-on-demand type recording head. Although drop-on-demand inkjet type line-scan inkjet recording devices have a slower printing speed than do continuous inkjet type devices, they have an extremely simple ink system and so are well suited for a general-purpose high-speed recording device.

Japanese Patent-Application Publication No. 2001-47622 discloses a drop-on-demand line-scan inkjet recording head that includes a plurality of head modules aligned across the width of the recording sheet. Each head module is formed with a nozzle row that includes a plurality of nozzle orifices. The nozzle rows are slanted at an angle with respect to a sheet feed direction. By using the plurality of head modules, the nozzle pitch in the widthwise direction of the recording sheet can be set quite small, so that high resolution images can be formed.

Some nozzles of the drop-on-demand line-scan inkjet recording head will not be fired for long periods of time because ink droplets are only ejected as needed to form recording dots in accordance with recording data. If nozzles are not fired for long periods of time, then ink near the nozzle orifice can dry. This unstabilizes ink ejection performance. In order to overcome this problem, the present applicant has proposed to dispose a charge deflecting electrode on the surface of each head module in U.S. patent application Ser. No. 10/363,822, now U.S. Pat. No. 6,796,632 to Yamada et al. issued Sep. 28, 2004. Each charge deflecting electrode is oriented parallel with the corresponding nozzle row and includes an ink receiving portion. The charge deflecting electrodes generate a slanted electric field that deflects ink droplets from the nozzle orifices to impinge on a desired location of the recording sheet. The slanted electric field also deflects refresh ink droplets from the nozzle orifices to U-turn away from the recording sheet and impinge on the ink receiving portion, where the ink is collected. By selectively ejecting refresh ink droplets in this manner, the problem of ink near the nozzle orifices becoming excessively viscous can be prevented so that ink ejection can be maintained stable.

Usually, a drop-on-demand inkjet recording head needs to be cleaned using a recording head cleaning device in order to maintain stabilized ink ejection. The recording head cleaning device removes viscous ink, deteriorated ink, or foreign matters, such as paper dust, that clings to the nozzle orifices. A purge unit is an example of such a recording head cleaning device. A purge unit performs a purge operation and a wiper operation. During purge operations, a cap is brought into intimate contact with one or more nozzle orifices, and ink is sucked from the nozzle orifices through the cap. The wiper operation is performed after the purge operation. During the wiper operation, a rubber blade is driven to slide across the area surrounding the nozzle orifices to wipe off the area and restore the ink meniscus to a proper condition. Japanese Patent-Application Publication No. 2001-260392 proposes a cleaning device that brings a suction hole of a suction nozzle into confrontation with, but not in contact with, a portion of the nozzle orifices. A negative pressure is developed in the suction hole while the suction nozzle is moved along the row of the nozzle orifices to clean the nozzle orifices.

However, the above-described purge unit cannot be easily used for the recording head described in U.S. Pat. No. 6,796,632. That is, the surface of the charge deflecting electrode is higher than the nozzle surface, so there is a level difference between the nozzle surface and the charge deflecting electrode that follows the nozzle orifice rows. This level difference makes difficult to side the blade around the nozzle orifices to restore the meniscus in the nozzle orifices.

The cleaning device disclosed in Japanese Patent-Application Publication No. 2001-260392 does not take the charge deflection electrode into consideration and so does not sufficiently clean areas around the nozzle orifices and the edge portion of the charge electrode. Foreign matter, such as paper dust and deteriorated ink, is easily caught in spaces where the ink receiving portion and the charge deflecting electrode connect, on burs produced when the charge deflecting electrode is cut, and in unevenness in the surface of the ink receiving portion. It has been difficult to properly removes foreign matter that clings in such areas.

SUMMARY OF THE INVENTION

In the view of foregoing, it is an object of the present invention to overcome the above problems, and also to provide a cleaning device that can effectively clean an inkjet head with an electrode provided on an orifice surface, and also an inkjet recording device including the cleaning device.

In order to attain the above and other objects, the present invention provides a cleaning device for cleaning an orifice surface of an inkjet head and a different level member having a surface at a different level than the orifice surface, the different level member forming a step between the orifice surface and the surface of the different level member, the orifice surface being formed with a row of nozzle orifices. The cleaning device includes an air flow generating unit formed with a suction hole positioned at the nozzle orifice. The air flow generating unit generates a spiraling current by sucking air into the suction hole. The air flow generating unit sucks ink from the nozzle orifice by drawing the ink in with the spiraling current.

There is also provided a cleaning device for cleaning an orifice surface of an inkjet head and a different level member attached to the orifice surface, the different level member having a surface at a different level than the orifice surface, thereby forming a step between the orifice surface and the surface of the different level member, the orifice surface being formed with a row of nozzle orifices. The cleaning device includes an air flow generating unit formed with a suction hole positioned at the nozzle orifice. The air flow generating unit generates a spiraling current by sucking air into the suction hole, the air flow generating unit sucking ink from the nozzle orifice by drawing the ink in with the spiraling current.

There is also provided an inkjet recording device including an inkjet head and a cleaning device. The inkjet recording device includes an orifice surface formed with a row of nozzle orifices, a different level member attached to the orifice surface, the different level member having a surface at a different level than the orifice surface, thereby forming a step between the orifice surface and the surface of the different level member, and an ink ejection unit that ejects ink droplets from each of the nozzle orifices. The cleaning device includes an air flow generating unit formed with a suction hole positioned at the nozzle orifice. The air flow generating unit generates a spiraling current by sucking air into the suction hole. The air flow generating unit sucks ink from the nozzle orifice by drawing the ink in with the spiraling current.

DETAILED DESCRIPTION OF THE EMBODIMENTS

Next, an inkjet recording device 100 including a recording head cleaning device according to a first embodiment of the present invention will be described. The inkjet recording device 100 is a deflecting, drop-on-demand, line-scan inkjet recording device.

Figure 1:
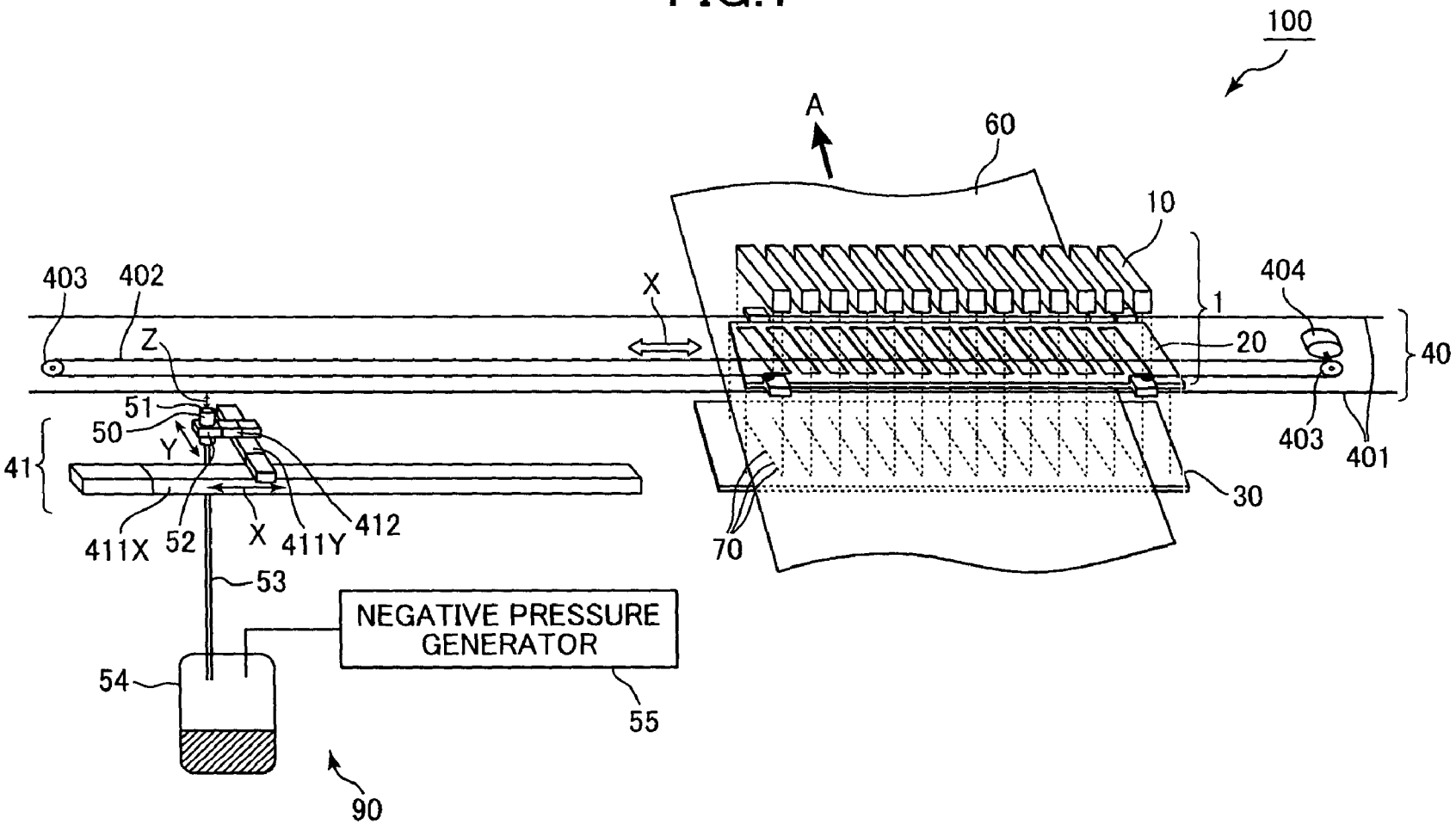
FIG. 1 is a perspective view schematically showing an inkjet recording device including a recording head cleaning device according to a first embodiment of the present invention and a recording head, wherein the recording head is located in a recording position.

As shown in FIG. 1, the inkjet recording device 100 includes a recording head 1, a back electrode 30, and a cleaning device 90. The recording head 1 includes a plurality of recording head modules 10 and a module mounter 20. The plurality of recording head modules 10 are aligned in a direction X, that is, the left and right directions as viewed in FIG. 1, and mounted on the module mounter 20. A recording sheet 60 is transported in a sheet transport direction A by a sheet feed mechanism (not shown). The back electrode 30 is disposed in confrontation with the module mounter 20 with the recording sheet 60 interposed between the back electrode 30 and the module mounter 20.

Figure 3:
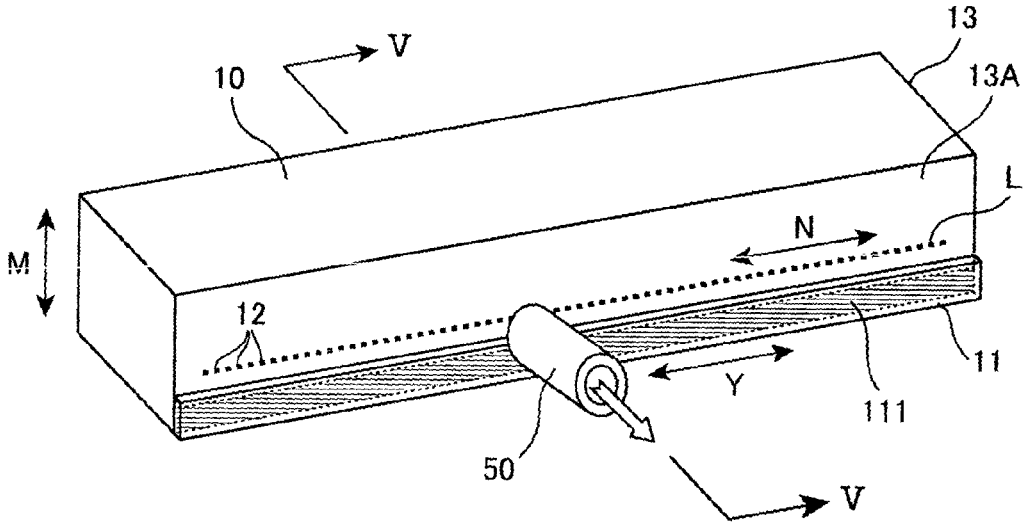
FIG. 3 is perspective view showing a recording head module of the recording head and a portion of the recording head cleaning device of the first embodiment.

As shown in FIG. 3, each recording head module 10 includes an orifice plate 13 formed from an electrically conductive member, such as metal. A nozzle orifice row L is formed in an orifice surface 13A of the orifice plate 13. The nozzle orifice row L is formed from n-number of nozzle orifices 12 that are aligned in a nozzle orifice row direction N and spaced from each other at a predetermined pitch. An electrode/ink reception member 11 is attached on the orifice surface 13A at a position about 300 microns separated from the nozzle orifice row L in parallel with the nozzle orifice row L. The electrode/ink reception member 11 serves both as a slanted electric field generating electrode for deflecting ink droplets and an ink reception member for receiving refresh ink droplets. The electrode/ink reception member 11 is formed in a plate shape to a thickness of 0.3 mm. An absorption member 111 is embedded in the surface of the electrode/ink reception member 11. The absorption member 111 is about 0.2 mm thick. An example of the absorption member 111 is a plate made from compressed stainless steel fibers or a porous sintered stainless steel plate.

Figure 4:
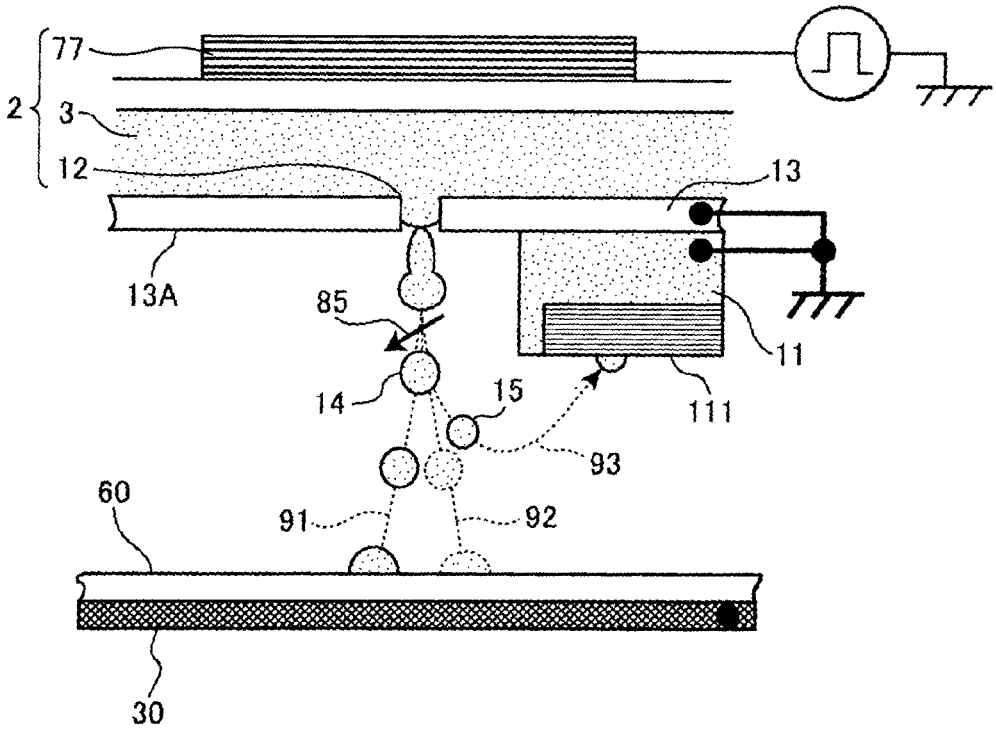
FIG. 4 is a cross-sectional view schematically showing ink ejection operations of the recording head module of the FIG. 3.

Next, configuration of the recording head modules 10 will be described with reference to FIG. 4. The recording head modules 10 are drop-on-demand, line-scan, inkjet recording head modules. Each of the recording head modules 10 has n-number of nozzle elements 2. Because all of the nozzle elements 2 have the same configuration, the following description will be made with reference to the representative example shown in FIG. 4. The nozzle element 2 includes the nozzle orifice 12 formed in the orifice plate 13, an ink pressure chamber 3, and an actuator 77. The actuator 77 may be a PZT piezoelectric element. The ink pressure chamber 3 is opened to the nozzle orifice 12 and filled with ink. The actuator 77 is attached to the ink pressure chamber 3 and input with an ink droplet ejection signal based on a recording signal. The ink droplet ejection signal includes a recording ejection signal and a refresh ejection signal. Although not shown in the drawings, each of the recording head modules 10 is formed with ink inlet holes and a manifold. Each ink inlet hole guides ink to the corresponding ink pressure chamber 3 from the manifold. The electrode/ink reception member 11, the orifice plate 13, and the ink in the nozzle elements 2 are all electrically connected to ground. Therefore, a slanting electric field 85 is generated between the back electrode 30 and the electrode/ink reception member 11 and the orifice plate 13 when a charge deflection control signal is applied to the back electrode 30.

When the ink ejection signal is input to the actuator 77, the actuator 77 changes volume of the corresponding ink pressure chamber 3, thereby ejecting an ink droplet from the corresponding nozzle orifice 12. At this time, a recording ink droplet 14 is ejected when the ink ejection signal is the recording ejection signal, but a refresh ink droplet 15 is ejected when the ink ejection signal is the refresh ejection signal. The recording ink droplet 14 is charged and deflected by the slanting electric field 85 and follows one of deflected trajectories 91, 92 to impinge on the recording sheet 60, thereby forming a recording dot 70 (FIG. 1) on the recording sheet 60. A desired image can be recorded by a number of the recording dots 70. The refresh ink droplet 15 is charged and deflected by the slanting electric field 85 and follows a U-turn trajectory 93 toward the absorption member 111 without impinging on the recording sheet 60. The refresh ink droplet 15 impinges on and is collected by the absorption member 111. The collected ink is sucked away through capillaries in the absorption member 111.

By ejecting the refresh ink droplets 15, the ink in the nozzle orifice 12 can be prevented from drying and becoming overly viscous. Therefore, ink can be reliably ejected from the nozzle elements 2 and reliability of the recording head 1 is greatly enhanced. By deflecting the recording ink droplet 14 to control the impingement position of the recording ink droplet 14, several nozzle elements 2 can be used to eject recording ink droplets 14 to produce a single recording dot. With this configuration, loss of recording information can be prevented even if one or more of the nozzle elements 2 becomes defective because the recording dot will be printed by the other nozzle elements 2. Also, erratic patterns that can appear in images due to variation in ink ejection characteristics of the nozzle elements 2 can also be prevented.

Next, the cleaning device 90 for cleaning the recording head 1 will be explained. The cleaning device 90 removes viscous ink, deteriorated ink, and foreign matter, such as paper dust, that clings to the electrode/ink reception member 11 and near the nozzle orifice 12 and forms the meniscus in the nozzle orifice 12 from fresh ink. This stabilizes ink ejection and control of deflection of ink droplets so that proper recording can be achieved.

Figure 2:
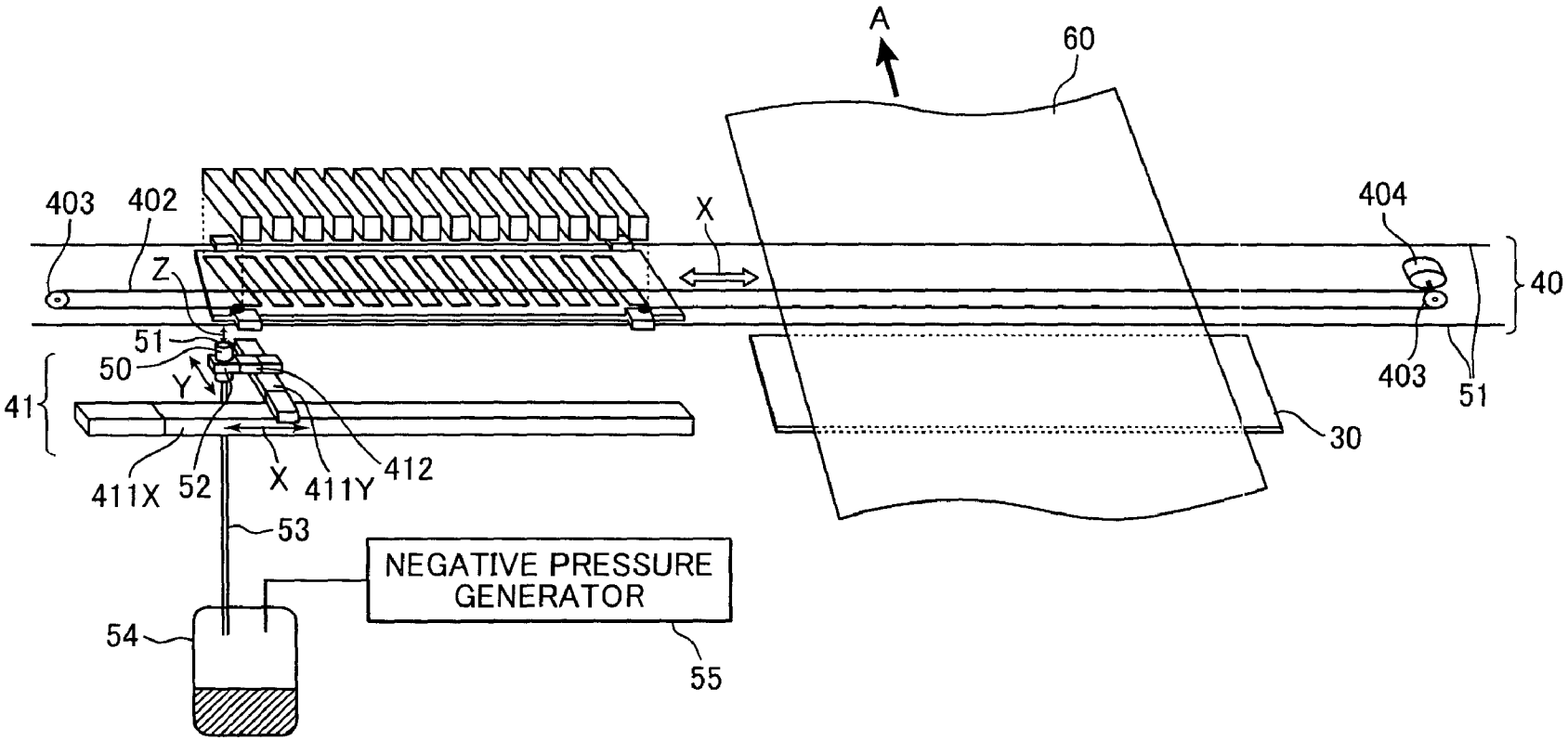
FIG. 2 is a perspective view schematically showing the inkjet recording device of FIG. 1, wherein the recording head is located in a cleaning position.

As shown in FIG. 1, the cleaning device 90 includes a head retracting mechanism 40, a suction tube positioning mechanism 41, a suction tube 50, an ink collection tank 54, and a negative pressure generator 55. The suction tube 50 is formed with a suction hole 51. The head retracting mechanism 40 moves the recording head 1 from a recording position shown in FIG. 1 to a cleaning position shown in FIG. 2 for cleaning. The head retracting mechanism 40 includes a pair of linear rails 401, 401, a timing belt 402, a pair of pulleys 403, 403, and a retraction drive motor 404. The timing belt 402 is wrapped around the pulleys 403, 403 and connected to the module mounter 20 of the recording head 1. When the pulleys 403, 403 are rotated by the retraction drive motor 404, the timing belt 402 follows the linear rails 401. By this, the recording head 1 can move in the direction X.

The suction tube positioning mechanism 41 is located at a predetermined cleaning position that is separated from the recording position. The suction tube positioning mechanism 41 includes an X-axis movement stage 411X, a Y-axis movement stage 411Y, and a suction hole approach mechanism 412. The X-axis movement stage 411X moves the suction tube 50 in an X-axis direction, and the Y-axis movement stage 411Y moves the suction tube 50 in the Y-axis direction. It should be noted that in the present embodiment, the Y-axial direction is set parallel with the nozzle orifice row direction N. The suction hole approach mechanism 412 is mounted on the Y-axis movement stage 411Y and movable in a vertical direction Z. The suction tube 50 is made from resilient silicone to have a diameter of about 3 mm. The suction tube 50 is attached to the suction hole approach mechanism 412 by a suction tube attachment portion 52. The suction tube 50 is connected to the negative pressure generator 55 through a tube 53 and the ink collection tank 54.

Next, cleaning operations of the cleaning device 90 will be described. First, the head retracting mechanism 40 moves the recording head 1 from the recording position shown in FIG. 1 to the cleaning position shown in FIG. 2. Next, while the negative pressure generator 55 generates a suction at the suction hole 51, the X-axis movement stage 411X and/or the Y-axis movement stage 411Y move the suction tube 50 to position the suction hole 51 below the nozzle orifice 12 and the electrode/ink reception member 11. Then, the suction hole approach mechanism 412 moves upward in the vertical direction Z to press the suction tube 50 against the step between the orifice plate 13 and the electrode/ink reception member 11 by a force that seals the suction tube 50 against the orifice plate 13 and the electrode/ink reception member 11 except for a gap 511 shown in FIG. 5. The gap 511 includes a broad section 511L and a narrow section 511S. As viewed from the nozzle orifice 12, the broad section 511L is located at the side of the gap 511 nearest the electrode/ink reception member 11, and the narrow section 511S is located at the opposite side. Therefore, if the center of the nozzle orifice 12 is considered the center of the gap 511, the gap 511 is asymmetrical about the nozzle orifice 12 in a direction M, that is, asymmetrical about the nozzle orifice row L. Then, the Y-axis movement stage 411Y moves the suction tube 50 in the Y-axis direction, that is, in the nozzle orifice row direction N, so that the suction tube 50 slides across the orifice surface 13A of the orifice plate 13 and the electrode/ink reception member 11 following the nozzle orifice row L, thus cleaning all of the nozzle orifices 12.

During the cleaning operation, a negative pressure of 20 kPa operates on the nozzle orifice 12 being suctioned by the suction hole 51, so that air bubbles or ink that has become excessively viscous due to drying of the ink are sucked out from the nozzle orifice 12 and replaced with fresh ink. At the same time, an air flow 56 is generated as air enters through the gap 511 due to the negative pressure suction force in the suction hole 51. The different sizes of the broad section 511L and the narrow section 511S result in different flow velocities and flow rates in the air flow 56 at the different sections of the gap 511. That is, the distribution of flow velocities and flow rates in the air flow 56 is asymmetrical about the nozzle orifice 12 in the direction M. In other words, the distribution of flow velocities and flow rates in the air flow 56 is asymmetrical about the nozzle orifice row L. As a result, a whirlpool-shaped suction flow (spiraling current) 57 is formed in the vicinity of the suction hole 51. The whirlpool-shaped suction flow 57 includes a mixture of air and ink, forcibly pulls foreign matter away from the electrode/ink reception member 11 and the vicinity of the nozzle orifices 12, and washes off the foreign matter and the like from the electrode/ink reception member 11 or the nozzle orifice 12 with ink sucked from the nozzle orifice 12. The foreign matter is then sucked into the suction tube 50 and collected in the ink collection tank 54 through the tube 53. After the suction tube 50 is slid to the end of the nozzle orifice row L, a meniscus is formed from fresh ink in the nozzle orifice 12, thereby completing the purge and wipe operations.

When the cleaning operations are completed on one recording head module 10, then the X-axis movement stage 411X and the Y-axis movement stage 411Y are moved to locate the suction tube 50 at a position to start cleaning the orifice nozzles 12 of the adjacent recording head module 10. The above-described cleaning operations are performed on each of the remaining recording head modules 10 until the entire recording head 1 is cleaned.

As described above, the cleaning device 90 according to the present invention is capable of properly cleaning the area around the nozzle orifices 12 and the electrode/ink reception member 11 although the step is defined between the orifice surface 13A and the electrode/ink reception member 11. Also, the whirlpool-shaped suction flow 57 formed by a mixture of air and ink forcibly cleans foreign matter, such as cohered ink and paper dust, that clings to unevenness formed in the surface of the electrode/ink reception member 11. Because the suction tube 50 does not directly scrape against the nozzle orifices 12, the nozzle elements 2 will not be damaged nor will foreign matter be pushed into the nozzle orifices 12. Further, the negative purging pressure operates on each of the nozzle orifices 12 one after the other so that all of the nozzle orifices 12 can be properly purged. It is desirable to provide the orifice surface 13A and the like with water repellency, so that ink will be less likely to remain on the orifice surface 13A and efficiency of the wiper cleaning operation can be enhanced.

Here, if defectively ejecting nozzles or incompletely cleaned regions are discovered after the above cleaning operation is completed, then the suction hole 51 could be again set at the problem region to perform the cleaning concentrated at the particular region. With this configuration, less ink is used up during the cleaning process than in the conventional situation wherein all of the nozzles are cleaned at once.

It should be noted that there are no particular limitations to the present invention with respect to the number of sliding movements across the recording head modules 10 during cleaning, the direction in which the stages 411 are moved during cleaning, or the order in which the recording head modules 10 are cleaned. Although the embodiment describes that the movement direction Y of the Y-axis movement stage 411Y is parallel with the nozzle orifice row direction N, this is not to be construed as a limitation of the present invention. For example, the movement direction Y may be parallel to the sheet feed direction A. In this case, the X-axis movement stage 411X need to move in addition to the Y-axis movement stage 411Y as needed to slide the suction hole 51 following the nozzle orifice row L.

Figure 6:
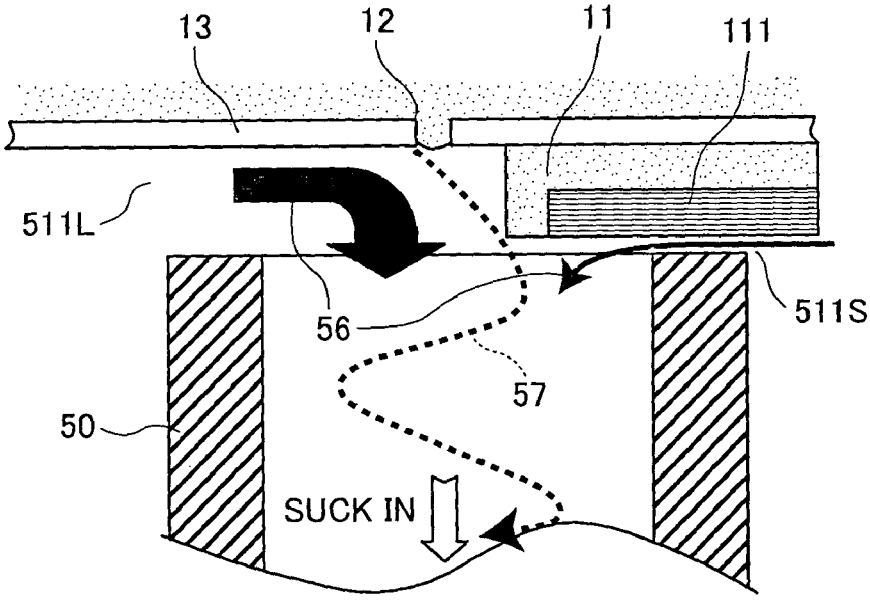
FIG. 6 is a cross-sectional view showing a recording head cleaning device according to a modification of the first embodiment.

Also, the suction tube 50 needs not be pressed against the orifice plate 13. For example, the suction hole 51 may be brought into confrontation with the nozzle orifice 12, without the suction tube 50 contacting the orifice plate 13 or the electrode/ink reception member 11 as shown in FIG. 6. Alternately, the suction tube 50 may be lightly pressed against the surface of the electrode/ink reception member 11. Either of these examples can be accomplished by adjusting the distance that the suction hole approach mechanism 412 moves in the vertical direction Z. In both of these modifications also, the gap 511 includes the narrow section 511S and the broad section 511L because of the step between the orifice plate 13 and the electrode/ink reception member 11. Therefore, the gap 511 is asymmetrical about the nozzle orifice row L. Accordingly, the distribution of flow velocity and flow rate in the air flow from the suction hole 51 is asymmetrical in the direction M.

Figure 5:
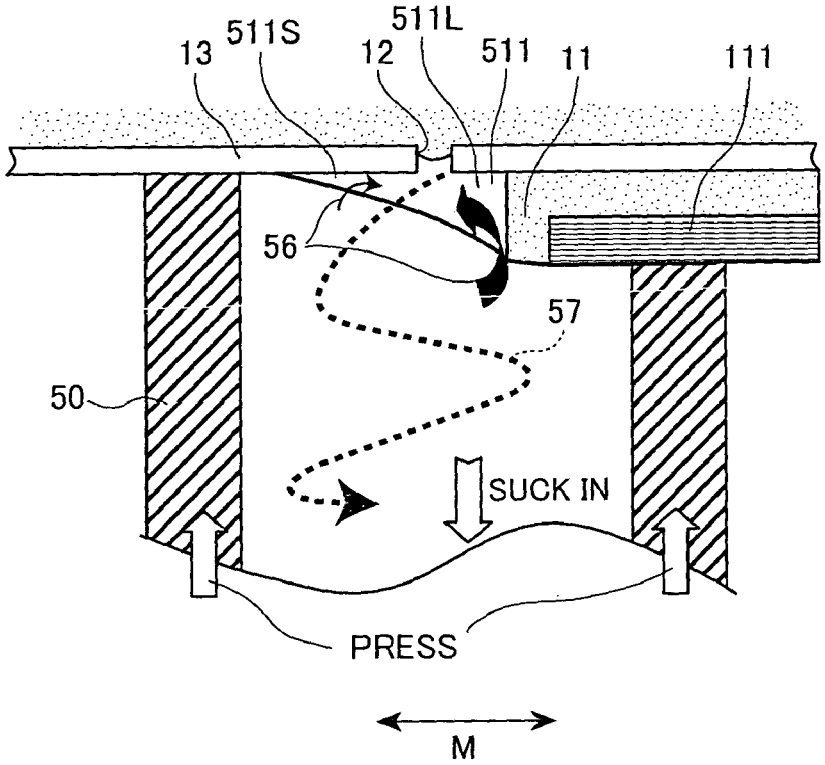
FIG. 5 is a cross-sectional view taken along line V—V of FIG. 3.

It should be noted that in these two modifications, the gap 511 is larger than the gap 511 of the first embodiment shown in FIG. 5. However, by increasing the suction flow rate of the negative pressure generator 55, a sufficient suction force of 10 kPa to 20 kPa can be achieved at the nozzle orifice 12 even if the gap 511 is large as in these modifications. Therefore, the same effects can be achieved as described above. An ejector that pneumatically generates a negative pressure is an example of a negative pressure generator capable of generating a large negative pressure. The present invention does not have any particular limitation on the type of device used as the negative pressure generator 55.

In these modifications, the suction tube 50 does not need to resiliently deform so the suction tube 50 can be made from a hard material such as fluororesin. Further, whether the suction tube 50 lightly contacts the electrode/ink reception member 11 or does not contact the electrode/ink reception member 11 at all, the orifice plate 13 will be abraded much less by the suction tube 50 moving along the orifice plate 13.

Next, a cleaning device 190 according to a second embodiment of the present invention will be described with reference to FIG. 7. It should be noted that components of the cleaning device 190 of the second embodiment that are substantially the same as those of the cleaning device 90 of the first embodiment will be referred to using the same reference numbers, and detailed explanation thereof will be omitted to avoid redundancy of explanation.

Figure 7:
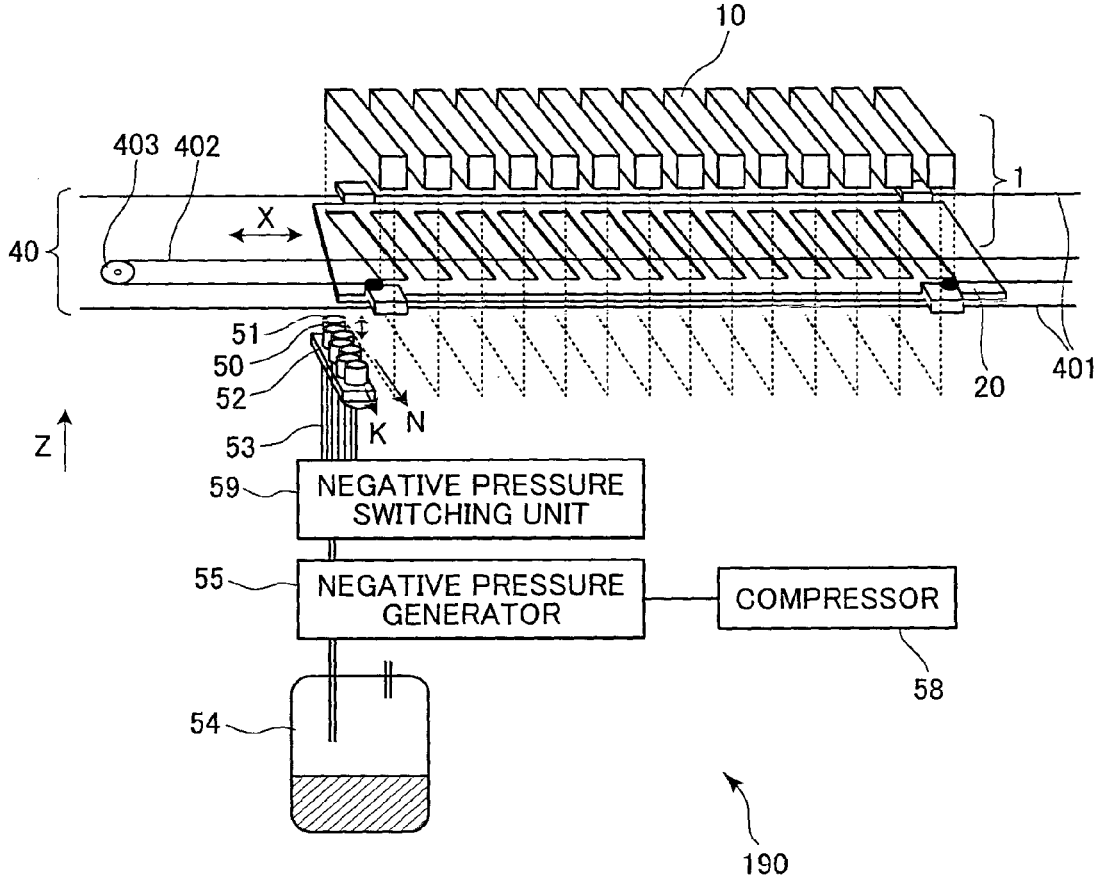
FIG. 7 is a perspective view schematically showing a recording head cleaning device according to a second embodiment of the present invention.

As shown in FIG. 7, the cleaning device 190 includes a head retracting mechanism 40, a plurality of suction tubes 50, a suction tube attachment portion 52, an ink collection tank 54, a negative pressure generator 55, a compressor 58, and a negative pressure switching unit 59. The suction tube attachment portion 52 extends in a direction K, which slants at a predetermined angle from the nozzle orifice row direction N. The suction tubes 50 are juxtaposed on the suction tube attachment portion 52 in a staggered arrangement continuously. The suction tubes 50 are each formed with a suction hole 51 and provided in a one-to-one correspondence with the nozzle orifices 12. The negative pressure switching unit 59 sequentially switches which of the suction tubes 50 is applied with a negative pressure.

When cleaning operations are to be performed, first the recording head 1 is moved until at least two adjacent nozzle orifices 12 are brought into confrontation with the corresponding suction holes 51. Then the suction tube attachment portion 52 is moved in the vertical direction Z until the suction tubes 50 press against the step between the orifice plate 13 and the electrode/ink reception member 11 in the same way as described for the first embodiment. Next, a suction force is developed at the at least two suction holes 51 while the recording head 1 is moved in the direction X to clean the nozzle orifices 12 and the nearby electrode/ink reception member 11. By moving the recording head 1 by a predetermined distance, at least two other nozzle orifices 12 are brought into confrontation with the corresponding suction holes 51. The negative pressure switching unit 59 is switched while moving the recording head 1 in the direction X to start suction at the at least two suction holes 51. Repeating these operations cleans all of the recording head modules 10.

This configuration achieves the same effects as in the first embodiment and further enables quickly cleaning the recording head 1 without the need for the X-axis movement stage 411X or the Y-axis movement stage 411Y for moving the suction tubes 50 in the X and Y directions.

As described above, according to the present invention, the recording head 1 can be reliably cleaned even if a step, resulting from two different levels, is formed on the orifice surface 3A. Therefore, defective ink ejection and the like caused by dust and other foreign matter can be avoided. A high-speed inkjet recording device capable of reliably recording high-quality images can be achieved.

While the invention has been described in detail with reference to the specific embodiments thereof, it would be apparent to those skilled in the art that various changes and modifications may be made therein without departing from the spirit of the invention.

For example, the present invention may be applied to a recording device that is not provided with an electrode/ink reception member 11 or an absorption member 111. That is, the embodiments described the step on the orifice plate 13 as being formed by the electrode/ink reception member 11. However, the step may be formed from a humidification member that humidifies the area around the nozzle orifices or an ink absorbing member that absorbs ink that leaks from the nozzle orifices. Alternatively, the effects of the present invention can be achieved if the step is provided for prevented the recording sheet from contacting the nozzle orifices 12.

Moreover, in the above described embodiment, the step is formed between the orifice plate 13 and the electrode/ink reception member 11 attached onto the orifice plate 13. However, such a step could be the one that is formed to the orifice plate 13 without any member attached onto the orifice plate 13.

Figure 8:
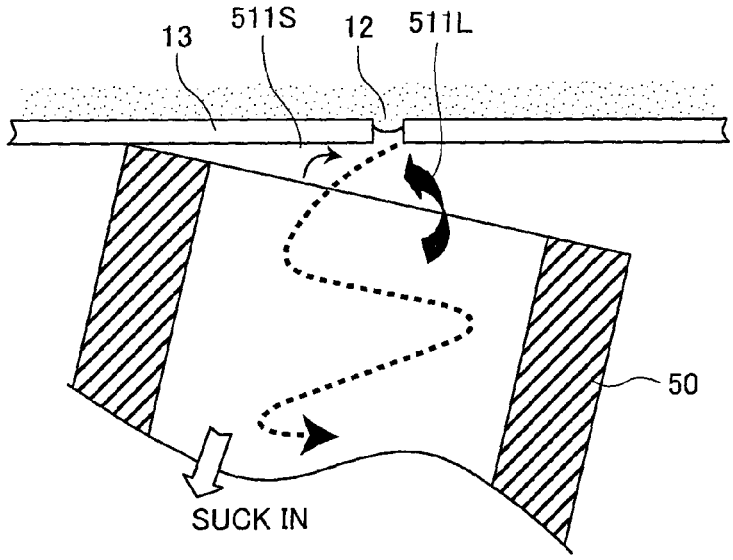
FIG. 8 is a cross-sectional view showing a recording head and a recording head cleaning device according to a third embodiment of the present invention.

In the above-described first and second embodiments, the region from the nozzle orifices 12 to the electrode/ink reception member 11 and the electrode/ink reception member 11 are brought into confrontation with the suction holes 51, and then ink is sucked from the nozzle orifices 12 while simultaneously generating the whirlpool-shaped suction flow 57. However, suction of ink from the nozzles and generation of the whirlpool-shaped suction flow 57 can be performed separately. For example, by tilting the suction tube 50 with respect to the orifice plate 13 as shown in FIG. 8, the whirlpool-shaped suction flow can be generated even if the recording head does not include the electrode/ink reception member 11. Alternatively, by cutting the tip end of the suction tubes 50 in a slant, the same whirlpool-shaped suction flow can be generated without tilting the suction tubes 50 with respect to the orifice plate 13.

What is claimed is:

1. A cleaning device for cleaning an orifice surface of an inkjet head and a different level member having a surface at a different level than the orifice surface, the different level member forming a step between the orifice surface and the surface of the different level member the orifice surface being formed with a row of nozzle orifices, the cleaning device comprising:

an air flow generating unit formed with a suction hole positioned at the nozzle orifice, the air flow generating unit generating a spiraling current by sucking air into the suction hole, the air flow generating unit sucking ink from the nozzle orifice by drawing the ink in with the spiraling current.

2. The cleaning device as claimed in claim 1, wherein the air flow generating unit sucks air in through the suction hole at asymmetrical flow velocity and flow rate about the row of nozzle orifices.

3. The cleaning device as claimed in claim 1, wherein the air flow generating unit includes:

a suction hole member formed with the suction hole;

a negative pressure generator that generates a negative pressure at the suction hole; and a positioning unit that positions the suction hole member at a suction position wherein the suction hole confronts the nozzle orifice and the different level member.

4. The cleaning device as claimed in claim 3, wherein a gap is formed between the suction hole member and at least one of the orifice surface and the different level member, the gap having a size that is asymmetric about the row of nozzle orifices.

5. The cleaning device as claimed in claim 4, further comprising a stage unit that moves the suction hole member following the row of nozzle orifices formed in the orifice surface.

6. The cleaning device as claimed in claim 3, wherein the suction hole member is formed with a plurality of suction holes, the negative pressure generator generates the negative pressure at at least two adjacent ones of the plurality of suction holes at a time while sequentially suctioning the plurality of suction holes.

7. The cleaning device as claimed in claim 3, wherein the suction hole member disposed at the suction position deforms while pressing against the orifice surface and the different level member without contacting the nozzle orifice.

8. The cleaning device as claimed in claim 3, wherein the suction hole member disposed at the suction position is distanced from the orifice surface without contacting the orifice surface.

9. The cleaning device as claimed in claim 1, wherein the different level member is attached to the orifice surface.

10. A cleaning device for cleaning an orifice surface of an inkjet head, the orifice surface being formed with a row of nozzle orifices, the cleaning device comprising:

an air flow generating unit formed with a suction hole positioned at the nozzle orifice, the air flow generating unit generating a spiraling current by sucking air into the suction hole, the air flow generating unit sucking ink from the nozzle orifice by drawing the ink in with the spiraling current.

11. The inkjet recording device as claimed in claim 10, wherein the air flow generating unit sucks air in through the suction hole at asymmetrical flow velocity and flow rate about the row of nozzle orifices.

12. An inkjet recording device comprising:

an inkjet head including:

an orifice surface formed with a row of nozzle orifices;

an ink ejection unit that ejects ink droplets from each of the nozzle orifices; and a cleaning device including an air flow generating unit formed with a suction hole position at the nozzle orifice, the air flow generating unit generating a spiraling current by sucking air into the suction hole, the air flow generating unit sucking ink from the nozzle orifice by drawing the ink in with the spiraling current.

13. The inkjet recording device as claimed in claim 12, wherein the inkjet head further includes a different level member having a surface at a different level than the orifice surface, the different level member forming a step between the orifice surface and the surface of the different level member.

14. The inkjet recording device as claimed in claim 13, further comprising a movement mechanism that moves the inkjet head between a recording position and a cleaning position, the different level member including a charge deflection electrode formed with an ink reception portion.

15. The inkjet recording device as claimed in claim 13, wherein the air flow generating unit includes:

a suction hole member formed with the suction hole;

a negative pressure generator that generates a negative pressure at the suction hole; and a positioning unit that positions the suction hole member at a suction position wherein the suction hole confronts the nozzle orifice and the different level member.

16. The inkjet recording device as claimed in claim 15, wherein a gap is formed between the suction hole member and at least one of the orifice surface and the different level member, the gap having a size that is asymmetric about the row of nozzle orifices.

17. The inkjet recording device as claimed in claim 16, further comprising a stage unit that moves the suction hole member following the row of nozzle orifices formed in the orifice surface.

18. The inkjet recording device as claimed in claim 15, wherein the suction hole member is formed with a plurality of suction holes, the negative pressure generator generates the negative pressure at at least two adjacent ones of the plurality of suction holes at a time while sequentially suctioning the plurality of suction holes.

19. The inkjet recording device as claimed in claim 15, wherein the suction hole member disposed at the suction position deforms while pressing against the orifice surface and the different level member without contacting the nozzle orifice.

20. The inkjet recording device as claimed in claim 15, wherein the suction hole member disposed at the suction position is distanced from the orifice surface without contacting the orifice surface.

21. The inkjet recording device as claimed in claim 13, wherein the different level member is attached to the orifice surface.

22. The inkjet recording device as claimed in claim 12, wherein the air flow generating unit sucks air in through the suction hole at asymmetrical flow velocity and flow rate about the row of nozzle orifices.

23. The inkjet recording device as claimed in claim 12, wherein said suction hole is positioned on a suction hole member tilted with respect to the nozzle orifice surface.

24. The inkjet recording device as claimed in claim 12, wherein said suction hole is positioned on a suction hole member having a tip end cut in a slant in order to provide an asymmetrical gap about the nozzle orifice.

* * * * *